US008791875B2

(12) United States Patent
Apostolos et al.

(10) Patent No.: US 8,791,875 B2
(45) Date of Patent: Jul. 29, 2014

(54) METHOD AND APPARATUS FOR AVOIDING PATTERN BLOCKAGE DUE TO SCATTER

(75) Inventors: John T. Apostolos, Lyndeborough, NH (US); David P. Charette, Hudson, NH (US); Roland A. Gilbert, Milford, NH (US)

(73) Assignee: BAE Systems Information and Electronics Systems Integration Inc., Nashua, NH (US)

( * ) Notice: Subject to any disclaimer, the term of this patent is extended or adjusted under 35 U.S.C. 154(b) by 421 days.

(21) Appl. No.: 13/187,715

(22) Filed: Jul. 21, 2011

(65) Prior Publication Data

US 2013/0021112 A1 Jan. 24, 2013

(51) Int. Cl.

| | |
|---|---|
| ***H01Q 15/04*** | (2006.01) |
| ***H01Q 15/06*** | (2006.01) |
| ***H01Q 1/52*** | (2006.01) |
| ***H01Q 15/00*** | (2006.01) |
| *H01Q 3/44* | (2006.01) |

(52) U.S. Cl.

CPC ..... *H01Q 15/0066* (2013.01); *H01Q 15/002* (2013.01); *H01Q 1/52* (2013.01); *H01Q 3/443* (2013.01)

USPC ..... 343/909; 343/755; 343/913

(58) Field of Classification Search

CPC ... H01Q 1/52; H01Q 15/242; H01Q 15/0066; H01Q 15/002; H01Q 3/443

USPC ..... 343/909, 913, 753–754

See application file for complete search history.

(56) References Cited

U.S. PATENT DOCUMENTS

| | | | | |
|---|---|---|---|---|
| 6,774,745 | B2 * | 8/2004 | Apostolos | 333/161 |
| 7,218,281 | B2 * | 5/2007 | Sievenpiper et al. | 343/700 MS |
| 7,830,310 | B1 * | 11/2010 | Sievenpiper et al. | 343/700 MS |

* cited by examiner

*Primary Examiner* — Robert Karacsony
*Assistant Examiner* — Amal Patel
(74) *Attorney, Agent, or Firm* — Daniel J. Long

(57) ABSTRACT

A method and apparatus is provided for avoiding pattern blockage due to scatter from an object in which an artificial surface directs the energy from the antenna prior to arriving at a blocking structure such that either the wave fronts of the energy are linear when they arrive at the blocking structure or the phase of the energy incident on the object is adjusted such that the energy reflected from the object is in phase with energy directly from the antenna radiating elsewhere in the far field pattern, or both.

8 Claims, 6 Drawing Sheets

Variable Impedance Transmission Line (VITL)
Array Based Artificial Surface

- The propagation constant of each line is proportional to sqrt (h/L)
- The propagation constant can be made a function of x, y by control of L and h over the whole array
- The height h is large enough for the array to radiate and receive energy

Cellular Approach to an Artificial Surface

- Each cell acts as an independent reflector
- The delay of a cell is determined by the VITL structure acting as a shorted Transmission LMO attached to the feed of the active elements

METHOD AND APPARATUS FOR AVOIDING PATTERN BLOCKAGE DUE TO SCATTER

FIELD OF THE INVENTION

This invention relates to mitigation of pattern blockage and pattern nulls due to the scattering of RF energy from an object near an antenna and more particularly to the use of an artificial surface which collects and reradiates energy from the antenna prior to arriving at the blocking structure such that the wave fronts of the energy are linear when they arrive at the blocking structure and such that the reflected energy from the blocking structure is adjusted.

BACKGROUND OF THE INVENTION

It is noted that it is nearly impossible to locate antennas on airborne platforms that have a perfect 360° field of view. Usually there is a close obstruction or scatterer in a particular direction that prevents the antenna from seeing around it. A shadow related to the blockage width is cast upon the pattern of the antenna along the direction of the obstruction. The result is a shadow area to the far side of the obstruction that blocks passage of RF energy, thus preventing the transmission or receipt of signals in that direction.

Adding extra antennas to cover these poorly illuminated areas is usually not an option due to the added weight of the antenna and cabling, as well as switching accessories, air drag, added cosite interference problems or simply the lack of room for another antenna.

There is therefore a need for providing a mechanism to mitigate the effects of scattering due to the obstruction and more particularly the pattern blockage so that a true 360° field of view coverage is achievable.

It is noted that an antenna emits spherical wave fields that are expanding away from the antenna. Monopole or blade-like antennas on a conductive surface radiate in a vertically polarized fashion such that a vertically polarized signal is emitted normal to the ground plane. Between the antenna and the obstruction are the near-field and perhaps including the Fresnel zone in which a free space wave and surface wave would expand radially producing a circular isophase front. The result is that the wave front of waves from the antenna impinges upon the obstruction in an arcuate or circular fashion.

The result of the impingement of an arcuate wave front on an obstruction in which the obstacle is in the near field of the antenna, is that a large shadow is created behind the object. This phenomenon is a result of Fresnel defraction.

When an obstacle is in the far field of the radiating antenna, the local field around the obstacle has a nearly equi-phase wavefront and is called a plane wave. The field blockage caused by the obstacle is a small percentage of the overall effective plane wave aperture around the obstacle. Hence blockage effects which are manifested by deep nulls in the radiation pattern are minimized.

However, absent any wave front reconfiguration when the obstacle is close to the radiating antenna i.e. within a few wavelengths, the field front is radial and is not a plane wave. What this means is that the wave front of the energy impinging upon the obstacle in the near field is curved, with the resulting defraction at the obstacle providing a wider swath or shadow behind the obstacle. This is because the area behind the obstacle is not filled in either close to the obstacle or at considerable distances. The result is that the obstacle blocks a significant amount of the radiating signal along its illuminating path line and to either side thereof extending the shadow region deeply into the far field.

In the past antenna engineers have tried to minimize the blockage of an obstacle by placing layers of dielectric materials around the obstacle to force "creeping" of the wave to flow around the object to fill and/or illuminate the shadow cast by the blockage. For complex obstacle shapes, placing of materials of appropriate thickness and orientation on the object is impractical.

Oftentimes antenna engineers will place radar absorbing material or other absorbing materials on the obstacle just to minimize the undesirable field defracting around the edges of the obstacle. However, the result is a reduction in the gain along the direction of the obstacle.

An additional problem with close obstructions is that they can reflect strong signals back to the antenna and beyond. If these reflections are out of phase, deep nulls in the antenna pattern may occur in the reverse direction.

SUMMARY OF INVENTION

Rather than utilizing the above means to minimize the shadow due to the obstacle, in the subject invention an artificial surface is placed between the antenna and the obstacle which is used to alter the phase of the signal reaching the obstruction. In one embodiment the artificial surface is a meanderline or variable impedance transmission line (VITL) that collects the surface wave from the antenna and reradiates it with controllable phase shifts.

This alteration can either flatten the phase of the wave front that impinges on the obstacle, or can alter the phase of a signal reflected by the obstacle to minimize nulls in the antenna pattern. When the artificial surface is used to flatten the phase of the radially expanding signal in front of the obstacle so as to present a plane wave front to the obstacle, the far field is filled in behind the obstacle, thus to minimize the shadow. By re-curving the wave front to be flat, the field illuminating the obstacle would have the appearance of a plane wave whose "effective aperture" is larger than the blockage aperture of the obstacle. This in turn would force more signal in the direction of the shadow, thus minimizing its darkness.

The second effect of the artificial surface is to provide that the energy that is collected and reradiated by the artificial surface impinges on the obstacle such that the energy reflected by an electrically conductive obstacle has phase that does not cancel energy from the antenna radiating away from the obstacle. By controlling the phase of the incident field on the obstruction before it is reflected, the phase of the backward reflecting signal can be made to add to or enhance the antenna radiation pattern in the opposite direction instead of creating nulls. In short, energy reflected from the obstacle is made to constructively add to the energy direct from the antenna.

Thus for the second effect the artificial surface acts to alter the phase of the energy impinging on the obstacle in such a way as to present the obstacle with phase shifted energy. This phase shifted energy impinges on the obstacle and reflects back to the antenna to add constructively in the far field with the direct-path energy from the antenna in that direction. Thus, the phase of the reflection can be adjusted by the meanderline structure to add constructively at a given direction in the far field.

As mentioned above, in order to reshape the wave front and/or to provide the required phase shift for energy reflected by an electrically conductive obstacle, what is used is a meanderline or the variable impedance transmission line array.

The variable impedance transmission line array generates the needed phase shifts to provide for either the flat wave front or the phase shift, with the variable impedance transmission line array being tuned to the transmitted frequency.

The meanderline or variable impendence transmission line arrays serve as a slow wave structure. While slow wave structures have been based on periodic placement of dielectric strips and layers to achieve a flat slope k-β diagram with nearly zero propagation group velocity, because of their periodic nature these materials are rather narrow banded. Moreover, they are also be heavy because some of the dielectric layers have to be of higher dielectric constant materials which translates into weight.

Another approach to slow wave technology is to place a parasitic antenna element in front of the radiating element, with the load impedance of the elements tuned to a particular frequency to compensate for the fixed position of the elements. A major problem of this approach involves the added large antenna elements and associated weight.

On the other hand, the low profile light meanderline structures can capture enough energy and can be used to fill the void cast by the obstacles shadow either by changing the spherical wave to a plane wave or by making sure that the reflected energy has an appropriate constructive addition phase.

The variable impedance transmission line in one embodiment includes multiple strip line sections of high and low impedance transmission line sections. The low impedance sections are closer to the ground plane and can be further loaded with varactors or other tunable capacitive components. The high impedance sections are those which are higher above the ground plane. Because of the height above the ground plane, these strip lines have high fringing fields which radiate or leak to free space. The fields in the lower impendence sections have much less fringing and thereby preventing leakage.

The result is that the wave front of the energy scattered from the antenna can be tailored or curved such that the original spherical curvature is transformed into a straight wave front by the artificial surface made up of the variable impedance transmission line array.

These meanderlines or variable impedance transmission lines can be tuned by providing piezoelectric material between the inner strip line sections and ground plane to vary the distance between the inner strip line sections and the ground plane. Note that the dielectric substrate and/or capacitive varactors between the low impedance inner strip line sections and the ground plane affects the propagation velocity and causes the propagation velocity to slow down. The propagation velocity in the high impedance sections is slowed by the dielectric medium it is embedded in. The forward propagation of a wave within a VITL is also delayed by the increased length of the transmission line as it "meanders" between high and low impedance sections.

As a result it is possible to tune the variable impedance transmission line or meanderline by varying the thickness of a piezoelectric layer between the transmission line and the ground plane such that the effective length of the variable impedance transmission line sections can be varied and therefore tuned to the a particular frequency. As a result it makes no difference if the artificial reflective surface is narrow banded.

Note in one embodiment the array of meanderlines is tapered in size, namely in length, to provide more delay directly in front of the antenna and less to the sides. In this manner it is possible to reshape the spherical wave front as it travels down the meanderline and to make its reradiation wavefront appear to be that of a plane wave.

In a different way of tuning the meanderlines, it is possible to program capacitors to the values needed for the appropriate delay at a given frequency. This can also be done using varactors.

The advantage of the meanderline or VITL construction is that the artificial surface may be constructed of lightweight foam or honeycomb material over a thin fiber glass substrate bonded to the ground plane in front of the obstacle. The entire structure can be enclosed in a lightweight radome material to form a composite structure. Note, the tuning of the meanderlines in effect is accomplished through the low impedances associated with the inner meanderline sections, whereby the delay can be controlled by electro-active actuators or varactor controlled capacitances, thus to be able to tune the meanderlines or VITLs to any specific operating frequency. The ability to tune the meanderlines means that the required phase of the collected and reradiated signal can be achieved through appropriate meanderline structures tuned to the operating frequency. Also, the ability to tune the meanderline array structure provides that the wave which finally impinges on the obstruction does in fact have a flat wave front, whereby it is less defracted by the structure, thus minimizing the shadow caused by the structure.

In summary what is provided is a method and apparatus for avoiding pattern blockage due to scatter from an object in which an artificial surface collects and reradiates energy from the antenna prior to arriving at a blocking structure such that either the wave fronts of the energy are linear when they arrive at the blocking structure or the reflected energy has an appropriate phase so that it constructively adds to energy in the far field that is direct from the antenna.

BRIEF DESCRIPTION OF THE DRAWINGS

These and other features of the subject invention will be better understood in connection with the Detailed Description, in conjunction with the Drawings, of which.

DETAILED DESCRIPTION

Figure 1A:
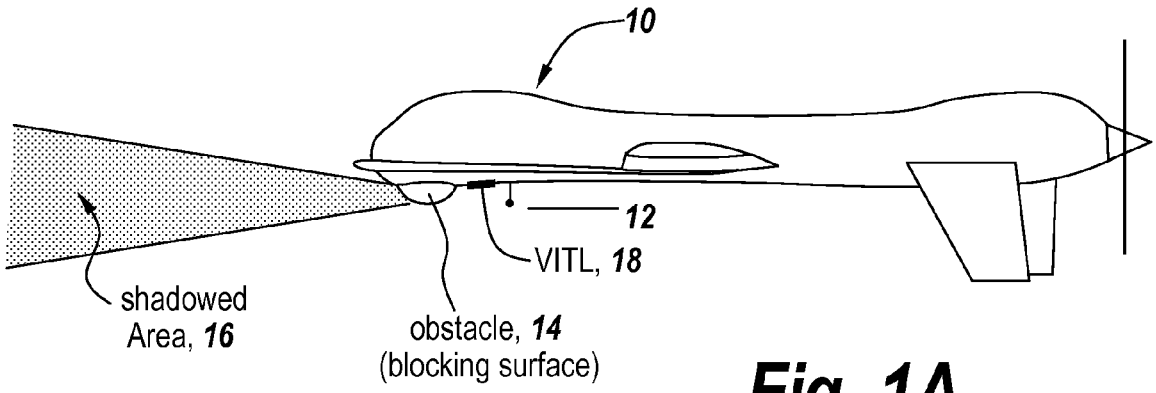
FIG. 1A is a diagrammatic illustration of the utilization of an artificial surface between an antenna on an aircraft and a blocking structure in which the blocking structure results in a shadow area.

Referring now to FIG. 1A, an aircraft 10 may be provided with an antenna 12 which is closely spaced to an obstacle 14 that constitutes a blocking surface such that radiation from antenna 12 is blocked by obstacle 14 to provide a shadowed area 16 in the far field. As will be discussed, an artificial surface in the form of a meanderline or VITL 18 is interposed between antenna 12 and obstacle 14, the purpose of which is to alter the phase of the energy that travels down the meanderline and towards the obstacle. As will be described it is the purpose of the meanderline or VITL 18 to alter the phase of the signal which is captured and reradiated towards the obstacle.

It will be noted that the meanderline or VITL is a slow wave structure which in one embodiment is an array of meanderlines.

Figure 1B:
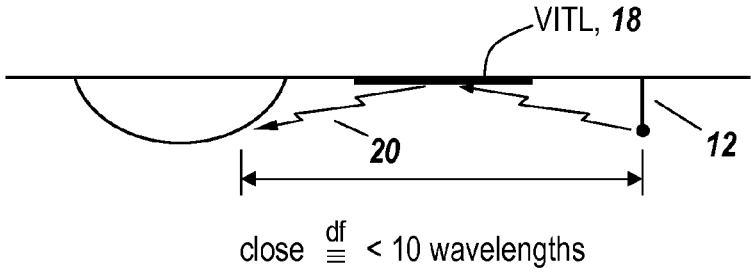
FIG. 1B is a diagrammatic illustration of a portion of FIG. 1A showing the close spacing that results in shadowing and also the portion of the artificial surface of FIG. 1A between the antenna and the blocking structure.

The blocking situation depicted in FIG. 1A is depicted in FIG. 1B and is a result of the antenna being close to the obstruction, for instance less than 10 wavelengths. Of course the closer the antenna is to the obstruction the more refraction around the obstruction occurs and the wider is the shadowed area to the far side of the obstruction.

As will be described, the meanderline takes the surface wave from the antenna to the obstruction, delays it and reradiates it with a controllable phase such that the phase of the reradiated signal here shown at 20 can be controlled. In one embodiment, as will be discussed, since the radiation from antenna 12 provides a circular wave front, VITL 18 alters the phase in such a way that the circular or arcuate wave front from antenna 12 is changed to a flatter plane wave front which minimizes the aforementioned shadowing.

In an alternative embodiment, the phase change imparted by the meanderline or VITL 18 is such as to establish a reflected wave from a metallic or electrically conductive obstacle such that the reflected wave has a phase which constructively adds to the energy from the antenna in a direction opposite to that of the obstruction.

Figure 2:
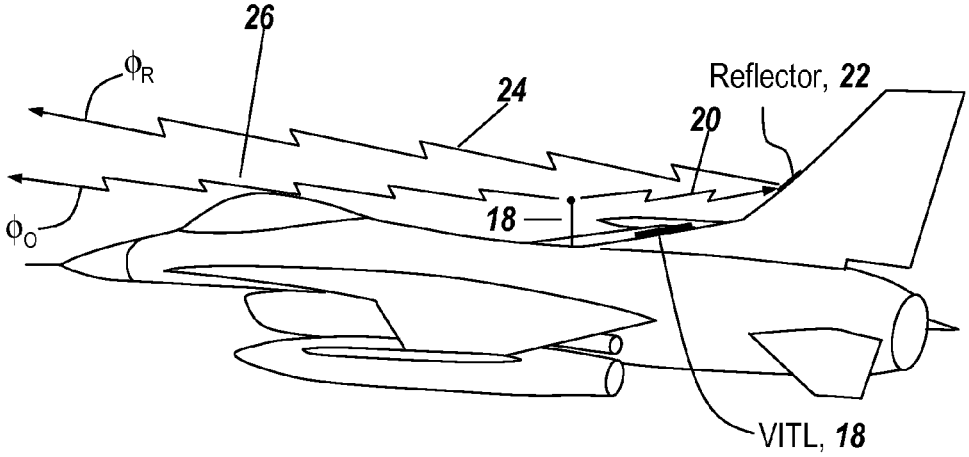
FIG. 2 is a diagrammatic illustration of the utilization of the artificial structure in the form of a meanderline or VITL to produce a phase shift in energy impacting a metallic blocking surface that alters the phase of the reflected energy such that there is a constructive addition of the reflected energy to energy direct from the antenna in the far field.

Such a situation is shown in FIG. 2 in which VITL 18 is used to adjust the phase of the reradiated signal 20 towards an electrically conductive reflector 22 that reflects the reradiated signal 20 while at the same time reversing the phase of the impinging signal such that the signal 24 which is reflected by reflector 22 is 180° out of phase with respect to the phase of signal 20.

The phase of signal 24 here designated $\phi_R$ is made to constructively add with the direct signal 26 from the antenna in the far field, with the phase of the direct signal being designated $\phi_0$.

It will be appreciated that the VITL may be used to adjust the surface signal from antenna 18 to the conductive reflective obstruction 22 such that the phase $\phi_R$ and $\phi_0$ constructively add in the far field, thus to eliminate nulls in the far field due to the reflections of the signal from antenna 16 by reflective obstruction 22.

Figure 3:
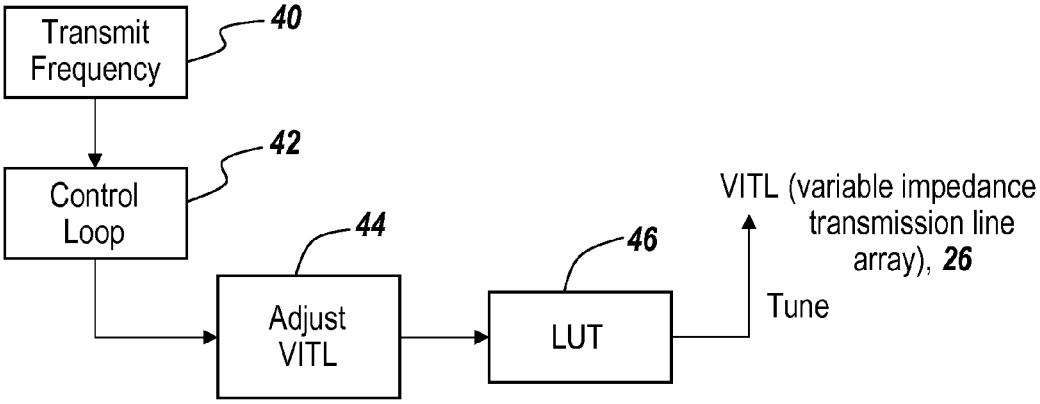
FIG. 3 is a block diagram of the subject invention in which the transmit frequency input to a control loop is used to adjust the variable impedance transmission line array through the utilization of a look up table that tunes the variable impedance transmission line array to the transmit frequency.

Referring now to FIG. 3, in one embodiment the transmit frequency 40 is sensed by a control loop 40 which adjusts the operating frequency of the meanderline or VITL as illustrated at 44. This in turn causes a look up table 46 to output various values to the variable impedance transmission line array 26 so as to tune the variable impedance transmission line array to a particular operating frequency, in this case the transmit frequency.

Figure 4:
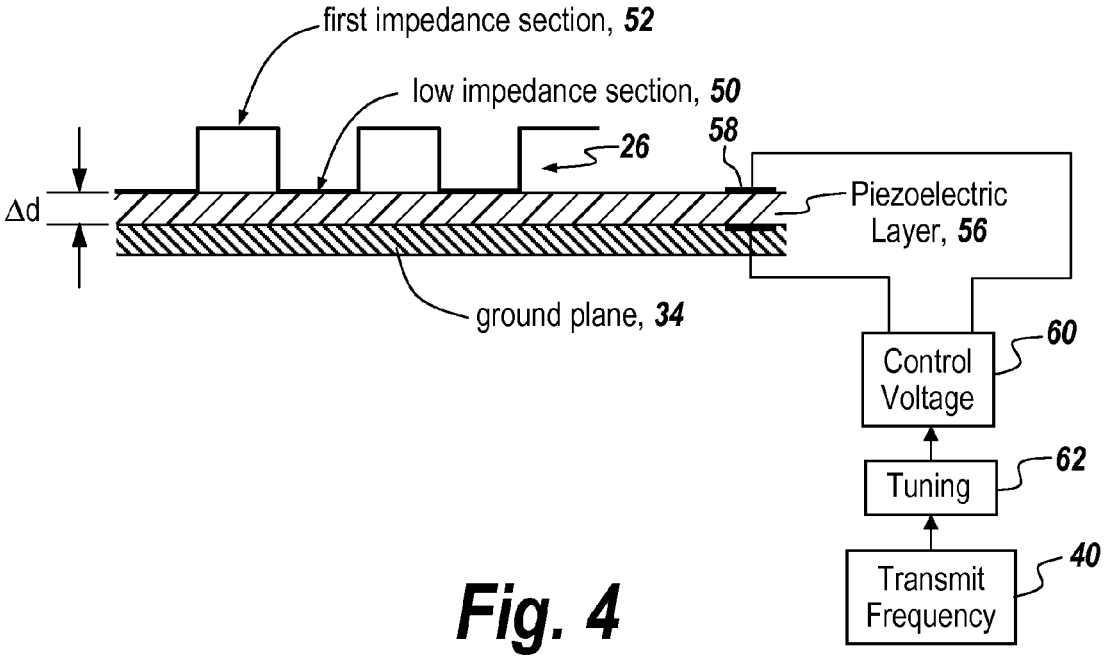
FIG. 4 is a diagrammatic illustration of one embodiment of the subject invention in which a variable impedance transmission line is tuned by varying the distance between the low impedance sections of the transmission line and the ground plane utilizing a piezoelectric layer across which is applied a control voltage that is set by the transmit frequency.

There are two methods by which a meanderline or variable impedance transmission line array can be tuned, one of which is illustrated in FIG. 4. Here the variable impedance transmission line array 26 includes a lower impedance section 50 and a higher impedance section 52. It turns out that the distance between the low impedance section 50 and ground plane 34, namely Δd, can be controlled through a piezoelectric layer 56 that is in turn controlled via electrodes 58 and control voltage 60 to vary the Δd distance and therefore the operating frequency of the meanderline or variable impedance transmission line. This is done by sensing the transmit frequency 40 and tuning the variable impedance transmission line as illustrated at 62 by altering control voltage 60.

Figure 5:
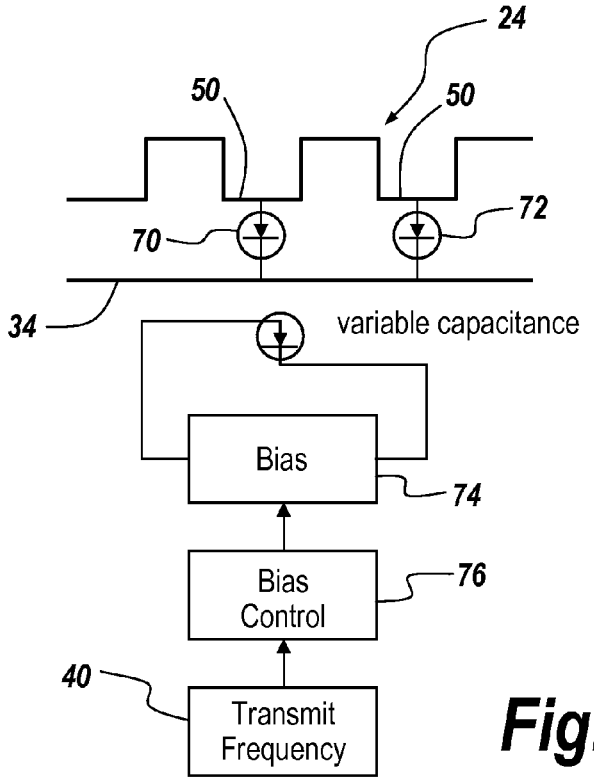
FIG. 5 is an alternative method of tuning the variable impedance transmission line array by utilizing varactors between the low impedance sections of the variable impedance transmission line array and the ground plane, with biasing of a varactor used to control the frequency at which the variable impedance transmission line array operates.

Alternatively, as seen in FIG. 5, the variable impedance transmission line 24 can be tuned utilizing varactors 70 and 72 between low impedance sections 50 and ground plane 34. Here the varactors are biased as illustrated at 74 by a bias voltage under the control of a bias control circuit 76 which is in turn controlled by transmit frequency 40.

As noted above, the load impedance of the elements needs to be tuned to a particular frequency to compensate for the fixed position of the elements. It is noted that what is desired for the variable impedance transmission line array or the meanderlines of which it is composed is to create a metamaterial that acts to create an equiphase aperture at the top of the material. To do so the radiating antenna element propagation velocity is delayed more looking directly into the material in a straight line between the antenna and the obstruction and with decreasing delay looking at side angles. This increases the gain of the antenna element by effectively increasing its effective aperture.

It is also possible to place dielectric material between the inner strip line sections and the ground plane to cause the propagation velocity to slow down. Note also that added length of line connecting the high and low impedance sections also contributes to the slowing of the wave relative to free space.

Note that propagation constant β achievable by each VITL array element, defined by a combined high Z section and a low Z section of equal length, is given by the following equation:

$$\beta = \beta_h + \beta_L = \omega\sqrt{\mu_o\varepsilon_h} + \omega\sqrt{\mu_o\varepsilon_L}$$

$$\beta = \omega\sqrt{\mu_o\varepsilon_h}\left[1 + \sqrt{\frac{\varepsilon_L}{\varepsilon_h}}\right] = \omega\sqrt{\mu_o\varepsilon_h}\left[1 + \frac{Z_h}{Z_L}\right] \approx \frac{\beta_o}{2}\sqrt{\frac{Z_h}{Z_L}}$$

where $\beta_h$ is the propagation constant of the high impedance section and is nearly equal to free space propagation constant $\beta_o$ if it is in air;

$\beta_L$ is the propagation constant of the low impedance section $\in_h$ is the dielectric constant of the high Z line medium which is equal to $\in_o$, the dielectric constant of air $\in_L$ is the dielectric constant of the low Z line substrate and is also directly proportional to additional capacitance due to varactors, ω is the radian frequency=2πf $$Z_h = \sqrt{\frac{\mu_o}{\varepsilon_h}} = \sqrt{\frac{L_h}{C_h}}$$

is the characteristic impedance of the high Z section and $L_h$ and $C_h$ are the characteristic inductance and capacitance of the high Z line, $$Z_L = \sqrt{\frac{\mu_o}{\varepsilon_L}} = \sqrt{\frac{L_L}{C_L}}$$

is the characteristic impedance of the low Z section and $L_L$ and $C_L$ are the characteristic inductance and capacitance of the low Z line.

It is therefore possible to program the capacitors to values needed for the appropriate delay at a given frequency.

Thus with respect to variable impedance transmission lines, the alternating high and low impedance segments provide an opportunity to provide a slow wave structure in which the propagation constant, in the case of equal length h and L transmission line sections, is proportional to the square root (h/L) impedances, with the characteristic impedance approximated by the geometric mean of the high and low impedances. Thus the delay can be controlled by electroactive actuators or varactor-controlled capacitances to set the operating frequency of the delay line and thus the system.

Figure 6:
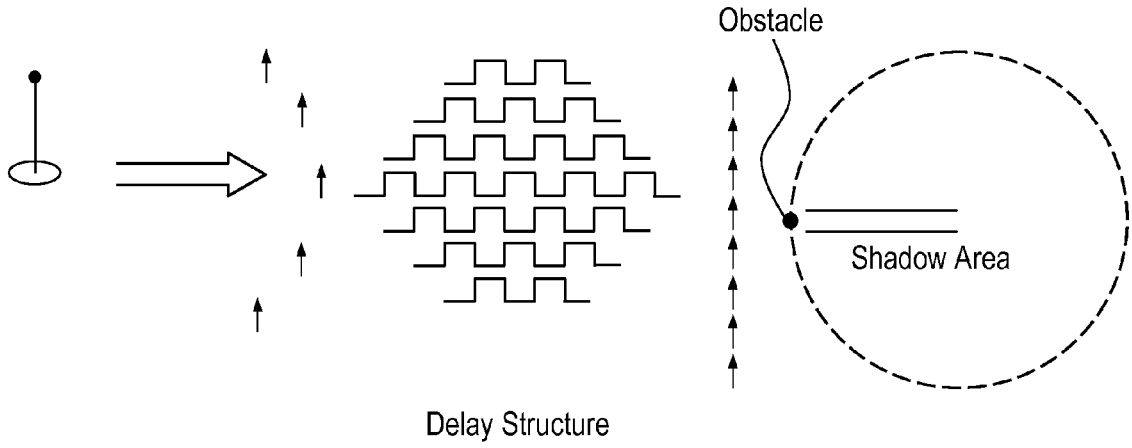
FIG. 6 is a diagrammatic illustration of the utilization of tapered or configured meanderlines in the path between an antenna and an obstacle to show the reshaping of the spherical wave to a plane wave that impinges on the obstacle to provide minimal shadow area.

As can be seen in FIG. 6, a spherical wave front 77 can be flattened by a properly tailored delay structure in the form of a variable impedance transmission line array 26 such that flattened straight wave front 78 is presented to obstacle 14 for a reduced shadow area 79.

Figure 7:
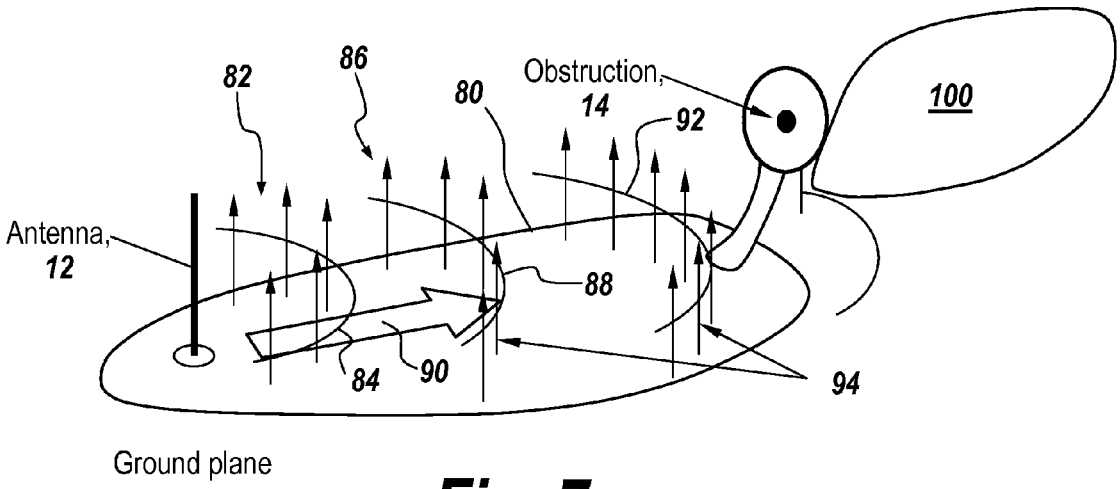
FIG. 7 is a diagrammatic illustration of the existence of spherical waves from an antenna which impinge on an obstruction that produces a relatively large shadow area.

The result of properly configuring the artificial surface is shown in FIG. 7. Antenna 12 is shown spaced from obstruction or blocking surface 14 with the near-field or Fresnel zone 80 existing between the antenna and the obstruction. As can be seen there is a near field 82 which is spherical as illustrated at 84. Note E field 86 is likewise spherical as illustrated at 88 as the wave propagates in the direction illustrated by arrow 90. The wave front 92 of the projected wave is arcuate as illustrated by the E field vectors 94 such that when the arcuate wave front impinges on the obstruction a relatively large far field shadow 100 results.

Figure 8:
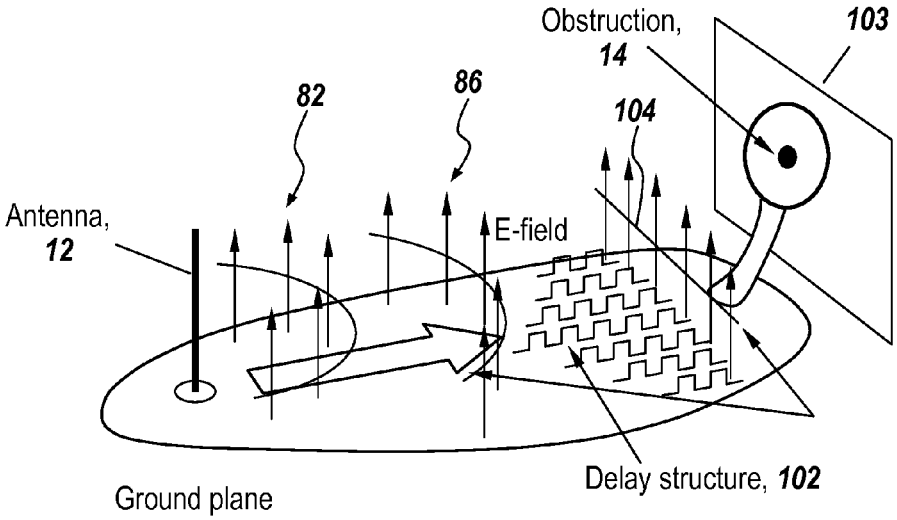
FIG. 8 is a diagrammatic illustration of the situation depicted in FIG. 7 in which delay structures in the terms of meanderlines are utilized to reshape the wave front of the energy from the antenna such that when the antenna energy arrives at the obstruction it arrives with a plane wave front, thus to minimize shadowing.

Referring to FIG. 8, in which like items carry like reference characters, it can be seen that the tapered delay structure 102 is effective in reshaping the spherical wave front into a linear wave front as illustrated at 104. The length of the particular meanderlines making up the variable impedance transmission line array is such that the wave front is more delayed toward the centerline between the antenna and the obstruction vis a vis the outer edges. These variable delays reshape the wave front from a spherical wave front to a planar wave front such that when a planar wave front impinges on obstruction 14, the effective aperture 103 is only partially blocked by the obstruction, which results in a minimized far field shadow.

Figure 9:
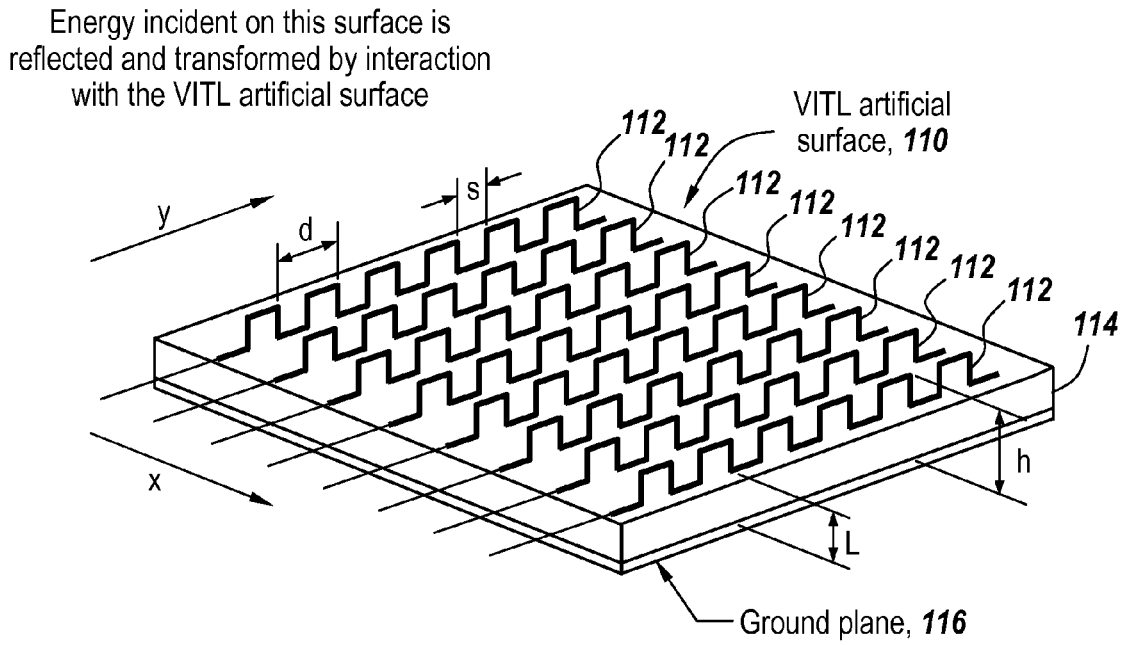
FIG. 9 is a diagrammatic illustration of a variable impedance transmission line array based artificial surface in which energy incident on the surface is reflected and transformed by interaction with the artificial surface; and, FIG. 10 is a diagrammatic illustration of an alternative approach to providing the artificial surface in which cells are created having active elements and associated VITL structures in which energy incident on the cell surfaces is transformed by interaction with the cellular artificial surface and in which each cell acts as an independent reflector, with the delay determined by the VITL structure acting as a shorted transmission line attached to the feed of the active elements.

Referring now to FIG. 9, a VITL artificial surface 110 is illustrated having a number of meanderlines 112 arrayed across a substrate 114 which spaces the meanderlines above a ground plane 116. Here the periodicity of the meanderline is indicated by d, whereas the length of the low impedance sections is illustrated by s. Note that the height of the high impedance sections above the ground plane is illustrated by h, whereas the distance between the ground plane and the low impedance sections is illustrated by L.

As mentioned hereinbefore, energy incident on the surface is reflected and is transformed by interaction with the VITL artificial surface, with the propagation constant of each line being proportional to SQRT(h/L). Note that the propagation constant can be made a function of x and y by control of L and h over the entire array. Moreover, the height h is large enough for the array to radiate and receive energy.

Figure 10:
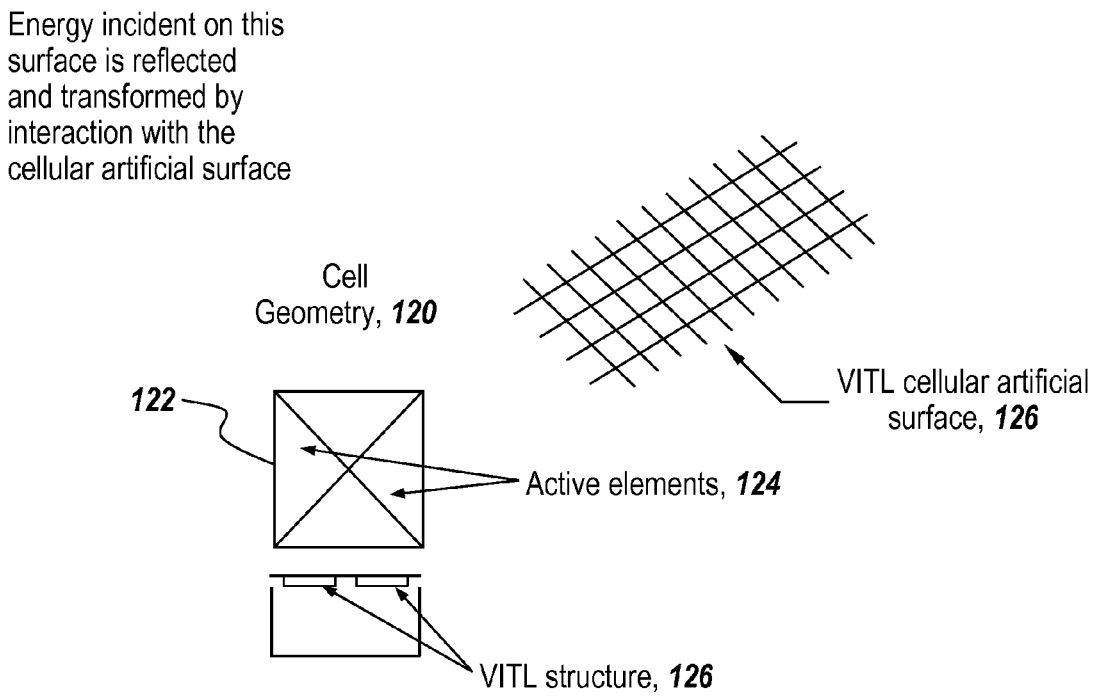

While FIG. 9 shows the utilization of a number of meanderlines on top of a substrate positioned on top of a ground plane to provide a slow wave structure, as illustrated in FIG. 10 a cell geometry 120 may be utilized in which a cell 122 is composed of active elements 124 having their feedpoints driven by a VITL structure 126 as illustrated. Each of the cells is arrayed across an area to provide the cellular artificial surface 126.

Energy incident on this surface is captured and transformed by interaction with the cellular artificial surface, with each cell acting as an independent receive and transmit antenna. The delay of a cell is determined by the VITL structure acting as a shorted transmission line attached to the feed of the associated active elements.

Whether the slow wave structure is provided by the meanderline structure of FIG. 9 or the cellular approach as illustrated in FIG. 10, the operation is the same. The structures are arranged either to flatten the phase of the incoming radially expanding signal from the antenna, or to assure that the phase of the reflected energy is coherent with the energy direct from the antenna to the far-field pattern in directions away from the obstruction.

While the present invention has been described in connection with the preferred embodiments of the various figures, it is to be understood that other similar embodiments may be used or modifications or additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. Apparatus for mitigation of pattern blockage due to the scattering of RF energy from an antenna that impinges on a blocking surface, comprising:

an artificial surface located between the antenna and the blocking surface on a ground plane, said artificial surface including a slow wave structure for altering the spherical wave front of the RF energy from the RF antenna that is collected and reradiated by said artificial surface, said artificial surface providing at least one of a flattened wave front for the energy collected and reradiated by said artificial surface that impinges on said blocking surface, said slow wave structure including a variable impedance transmission line array, said variable impedance transmission line array having an operating frequency which is tunable, said variable impedance transmission line array including a number of meanderlines each having a low impedance section and an adjacent high impedance section, wherein said slow wave structure includes a ground plane array and further including a layer for altering the distance between said low impedance section and said ground plane array, thereby to alter the operating frequency of said meanderlines and thus the operating frequency of said variable impedance transmission line, said layer including a piezoelectric layer, including a pair of electrodes, and further including a control voltage and means for applying the control voltage to said electrodes, said control voltage being set based on an predetermined operating frequency, corresponding to the transmit frequency for the RF energy radiated by said antenna, and further including a control loop for sensing said transmit frequency and for providing signals used to adjust the operating frequency of the variable impedance transmission line array.

2. The apparatus of claim 1, wherein said signals utilized to adjust the operating frequency of said variable impedance transmission line array are applied to a look-up table for setting tuning parameters for the tuning of said variable impedance transmission line array.

3. The apparatus of claim 1, wherein said artificial surface includes a number of cells, each of said cells having active elements that are actuated to receive and reradiate the incident energy with a predetermined delay, and further including a variable impedance transmission line structure for driving said active elements.

4. The apparatus of claim 1, wherein the meanderlines making up said high impedance section and said low impedance section are located above said ground plane and further including an electroactive actuator between said low impedance section and said ground plane for changing the operating frequency of said meanderlines.

5. The apparatus of claim 4, wherein said electroactive actuator includes a layer between said meanderline and said ground plane that alters the distance therebetween.

6. The apparatus of claim 4, wherein said electroactive actuator includes a variable capacitance element between said low impedance section and said ground plane.

7. The apparatus of claim 6, wherein said variable capacitance element includes a varactor.

8. The apparatus of claim 7, wherein the operating frequency of the RF energy from said antenna is sensed in a control loop coupled to a look up table configured to set the capacitance of said variable capacitance element in accordance with values in said look up table.

* * * * *